United States Patent [19]

Katz

[11] 4,180,339

[45] Dec. 25, 1979

[54] MECHANICAL PENCIL WITH AUTOMATIC LEAD FEED

[75] Inventor: Otto Katz, Schwabach, Fed. Rep. of Germany

[73] Assignee: A. W. Faber-Castell, Stein bei Nürnberg, Fed. Rep. of Germany

[21] Appl. No.: 919,950

[22] Filed: Jun. 28, 1978

[30] Foreign Application Priority Data

Jun. 29, 1977 [DE] Fed. Rep. of Germany ..... 2729320

[51] Int. Cl.[2] ..... B43K 21/02

[52] U.S. Cl. ..... 401/67; 401/65

[58] Field of Search ..... 471/65, 67–80, 471/82, 85, 86, 87, 53

[56] References Cited

U.S. PATENT DOCUMENTS

| | | | |
|---|---|---|---|
| 2,452,905 | 11/1948 | Collura | 401/65 |
| 2,911,948 | 11/1959 | Spector | 401/67 X |
| 3,408,147 | 10/1968 | Bleuer | 401/65 |
| 3,424,535 | 1/1969 | Schischkow | 401/53 |
| 3,437,413 | 4/1969 | Parker | 401/67 |
| 3,765,781 | 10/1973 | Hashimoto et al. | 401/67 X |
| 3,864,046 | 2/1975 | Butka | 401/67 X |
| 3,880,530 | 4/1975 | Katz | 401/65 |
| 3,945,733 | 3/1976 | Edel | 401/65 X |
| 3,947,133 | 3/1976 | Kogeyama | 401/65 X |

*Primary Examiner*—Edward M. Coven

*Attorney, Agent, or Firm*—Michael J. Striker

[57] ABSTRACT

A mechanical pencil with a lead feed, automatically produced by pressure during use of the pencil, comprises a tubular lead magazine closed at an outer end by a removable actuating button and being movably guided in a tubular housing, clamping elements in the housing actuatable by pressure on the actuating button and a lead guide tube projecting from a conical end of the housing and being movable against the pressure of a spring into the latter and carrying at the inner end thereof an entrainment element exerting friction on the lead passing therethrough, in which the clamping elements are movable by means of the actuating button against the force of a second weaker spring and guided by rolling elements along a conical guide face of a clamping cone, which in turn is axially movable between two end positions in the housing.

24 Claims, 27 Drawing Figures

FIG. 5
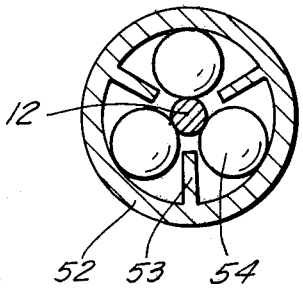
FIG. 6
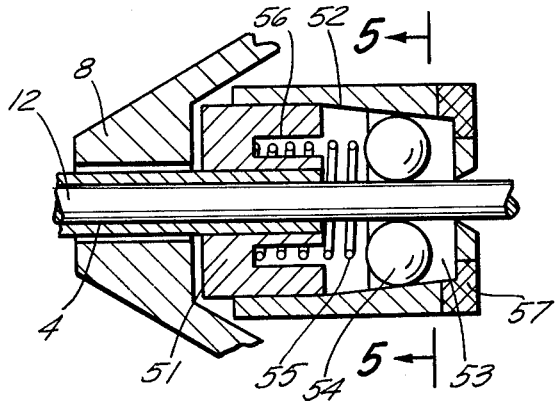
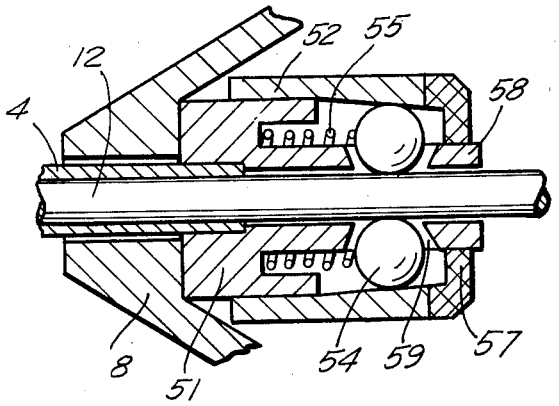
FIG. 7
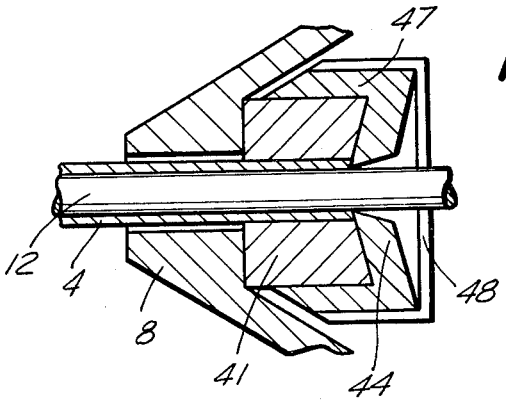
FIG. 8

MECHANICAL PENCIL WITH AUTOMATIC LEAD FEED

BACKGROUND OF THE INVENTION

A mechanical pencil with a lead magazine is already known from the DT-OS No. 21 53 400 and the corresponding U.S. Pat. No. 3,864,046 in which an automatic advance of the lead during use of the pencil as well as an automatic feed of leads from the lead magazine is to be carried out. For this purpose this mechanical pencil is provided with clamping tongs immovably held in axial direction, which in their rest position are open and which permit in this position a free advance of the lead from the lead magazine up to the inlet edge of an entrainment element. During writing a rear stroke of a lead tube is caused until the tension of a compression spring loading the lead tube is increased in such a manner that the clamping tongs are closed by means of a cone surface of a bushing, against which a compression spring abuts, preventing thereby a further inward movement of the lead. Subsequently thereto only the lead tube is further inwardly moved, whereby the entrainment element is moved over the lead. If now no load is exerted on the lead tube, the entrainment element moves along the lead, which is held by the clamping tongs. With this known construction it is, therefore, not possible to bring the lead into writing position only by loading and unloading the lead tube. Even if the lead is moved by hand into the lead tube so that the point of the lead is located at the outlet opening of the lead tube, then the lead tube together with the lead will carry out during loading a return stroke up to the clamping point of the tongs. During release of the lead tube the latter will then be forwardly moved, whereas the lead during part of this movement is still held by the clamping tongs so that the lead will remain behind the outlet opening of the lead tube. At subsequent loadings during use of the pencil, the lead will, therefore, travel further into the pencil. The function of an automatic advance of the lead is, therefore, not assured.

The U.S. Pat. No. 3,424,535 discloses a mechanical pencil in which advance of the lead during the use of the pencil, as well as advance of stored leads is to be caused automatically. To first insert a lead from a lead magazine, a spring loaded lead tube is loaded the same way as during writing and pushed into the housing of the pencil. A compression spring abuts against two clamping elements which are guided in a guide bushing. The clamping elements have conical clamping surfaces against which balls abut which are arranged in bores of the guide bushing, whereby the axial position of the clamping elements relative to the guide bushing remains fixed, until this unit is pushed so far back by the compression spring that the balls may escape into a lateral annular space. In this position the clamping elements are supposed to move radially away from each other, so that a lead from the lead magazine may move therebetween. A mechanism for this purpose is, however, not disclosed in this patent. If a lead is moved by hand between the clamping elements and the guide bushing together with the clamping halves are moved forwardly, while the lead tube is released, the balls move again into the clamping position. During renewed inward pressure of the lead tube, the balls remain, due to the presence of the lead, arrested in the clamping elements. During release of the lead tube, the lead is, however, not moved forwardly together with the same since the compression spring holds, on the one hand, the clamping elements in clamping position, but on the other hand, pushes the lead tube during release of the same forwardly.

The U.S. Pat. No. 2,911,948 discloses a mechanical pencil in which a lead tube, movable into the same, is fixedly connected with a clamping mechanism which, during use of the pencil, is released to slide rearwardly over the lead, whereas a second further inwardly located clamping mechanism holds the lead against rearward movement. During release of the lead tube, the lead will be moved by the first-mentioned clamping mechanism forwardly, whereas the second-mentioned clamping mechanism releases the lead. The disadvantage of this construction is that the clamping mechanisms, which are constructed as discs, each provided with a central hole, exert shearing forces onto the lead which, during writing, lead to a breaking of the latter. This construction has, therefore, not worked out in practice.

SUMMARY OF THE INVENTION

It is an object of the present invention to provide a mechanical pencil which avoids the disadvantages of such mechanical pencils known in the art.

It is a further object of the present invention to provide a mechanical pencil in which an automatic advance of the lead during writing is positively assured.

With these and other objects in view, which will become apparent as the description proceeds, the mechanical pencil according to the present invention mainly comprises a tubular housing, a tubular lead magazine coaxially guided in the housing movable between a retracted and an extended position in which one end of the tubular magazine projects further beyond one end of the housing than in the retracted position, a lead guide tube coaxially guided in the housing in the region of the other end of the latter movable between a first and a second position in which one end of the tubular lead guide projects through a smaller distance beyond the other end of the housing than in the first position, first spring means cooperating with the lead tube for biasing the latter to the first position, means for feeding a lead from the lead magazine into the lead guide tube and comprising tubular means coaxially guided in the housing between two end positions and having at one end adjacent the other end of the housing an inner conical guide face having a large diameter at the one end of the tubular means and tapering from the large diameter toward the axis of the tubular means, clamping means extending longitudinally through the tubular means and comprising a pair of resilient clamping arms having front ends adjacent said conical guide face and biased to move toward the latter and rolling elements carried by the front ends and engaging the conical guide face, the clamping means being movable relative to the tubular means between a rear clamping position in which the rolling elements are spaced from said one end of the tubular means to clampingly engage with clamping faces thereof a lead located therebetween and a forward releasing position, and second spring means weaker than the first spring means between the tubular means and the clamping means and biasing the latter to the clamping position, third spring means between the housing and the tubular lead magazine for biasing the latter to the extended position and constructed to yieldably couple the tubular lead magazine to the tubular means, whereby during movement of the tubular lead magazine from the extended towards the retractd position the tubular means is moved from one to the other of its end positions, cooperating means on the tubular magazine and the clamping means for moving the latter together with the tubular means during movement of the latter to the other end position while the clamping means remains in the clamping position so as to feed a lead clamped therebetween towards the lead guide tube until the tubular means reaches its other end position, whereby during further movement of the tubular lead magazine to the retracted position the clamping means is moved relative to the tubular means so that the rolling elements move towards the large diameter of the conical guide face causing thereby disengagement of the clamping faces from a lead therebetween, and entrainment means on the lead guide tube constructed to exert on a lead extending through the tube during movement relative to the tube in the housing a greater friction force than during movement of the lead relative to the tube in the opposite direction.

The construction and mounting of the clamping arms will assure that the opening and closing movement of the latter will occur fully symmetrically, that is the clamping arms cannot move axially relative to each other and they abut by means of the rolling elements also in their open position against the conical guide face of the tubular means. In this way transverse forces, which would be detrimental to an automatic advance of the lead, are avoided. The fully centered support of the clamping arms with respect to the conical guide face will further assure that only minimal forces acting in longitudinal direction are necessary for releasing the lead from the clamping arms. The fact that the entrainment means exert on the lead friction forces depending on the direction of movement of the lead, will assure that, on the one hand, the lead during outward movement of the lead guide tube will be taken along, and, on the other hand, during movement of the lead guide tube during use of the pencil into the housing, the lead will not be taken along by the entrainment element. The third spring which abuts with opposite ends against the housing and against the tubular lead magazine will assure that, when no pressure is exerted onto the outer end of the latter, the lead magazine will be returned to its extended position, whereby at the same time the clamping arms are returned by the second spring. This will assure at the same time a very small distance between the ends of the clamping arms and that of the entrainment element, whereby also the rest portion of the lead, which cannot be automatically advanced, is reduced to a minimum.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 5–11 illustrate in longitudinal and transverse cross-sections different constructions of the entrainment element used in the pencil according to the present invention.

DESCRIPTION OF THE PREFERRED EMBODIMENTS

Figure 1:
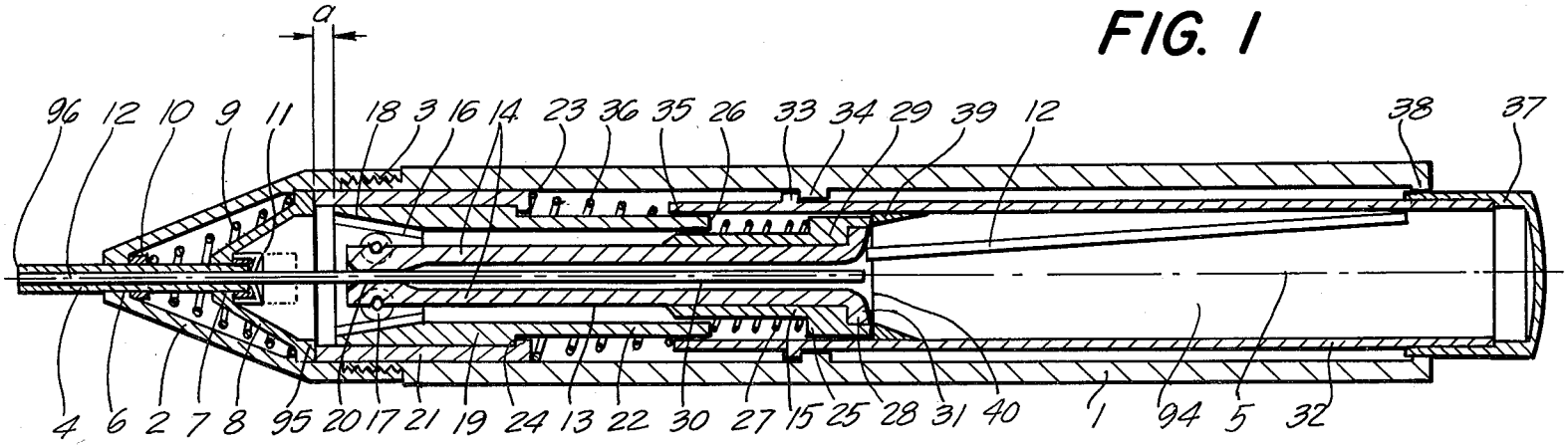
FIG. 1 is a longitudinal cross-section through a mechanical pencil according to the present invention, shown in normal writing position.

Referring now to the drawing, and more specifically to FIG. 1 of the same, it will be seen that the mechanical pencil according to the present invention comprises a substantially tubular housing 1 provided at one end with a conical member 2 which is releasably connected to the tubular portion of the housing by a screw thread 3. A lead tube 4 is movably mounted in the conical end portion 2 concentric to the axis 5 of the pencil and the lead tube 4 extends through a bore 6 in the conical portion 2 beyond the latter. The lead tube 4 is not only mounted in the bore 6 of the conical end portion 2, but also rearwardly thereof in the bore 7 of a frustoconically formed bearing 8, which is mounted at its large diameter end with a pressfit in the conical portion 2. A conical compression spring 9 abuts with its large diameter end against the axially fixed bearing 8 and with its other small diameter end against a support ring 10 which is axially immovably connected to the lead tube 4. Due to the conical construction, the compression spring 9 has in the very small working region a low elasticity constant. An entrainment element 11 is fixedly connected to the inner end of the lead guide tube 4 and the entrainment element is constructed, as will be described in further detail further below, in such a manner so as to exert on a lead 12 therein during movement of the lead guide tube into the conical portion 2 of the housing very small forces, but during outward movement of the lead guide tube very large taking along forces.

Figure 2:
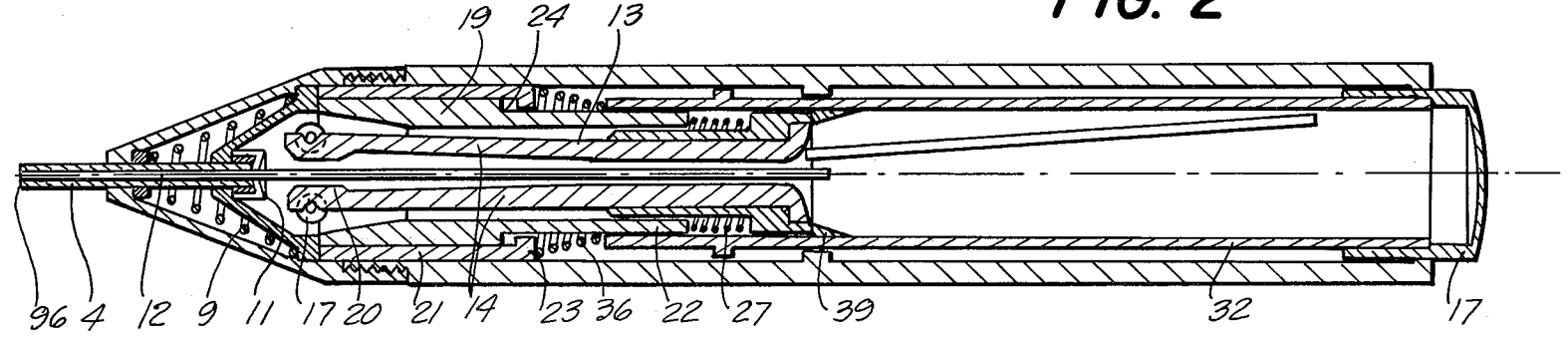
FIG. 2 is a longitudinal cross-section similar to FIG. 1 and illustrating the various elements during feeding of a new lead.

Clamping means 13 are likewise coaxially arranged in the housing 1 and constructed to hold the lead 12 against forces directed inwardly into the housing 1, as are exerted on the lead 12 during writing. The clamping means 13 serve further together with the entrainment element 11 to automatically advance the lead 12 in outward direction corresponding to its wear during writing. The clamping means 13 comprises two clamping arms 14 which, in the region facing away from the conical portion 2, are held together in axial and radial direction and immovably with respect to each other by a centralizing bushing 15. The clamping arms 14 are resilient and constructed in such a manner that they spring outwardly at the ends adjacent to the conical end portion 2, when these ends are radially released in the manner as illustrated in FIG. 2. A clamping zone 16 is provided in the region of the clamping arms 14 adjacent to the conical end portion 2 of the housing. Rolling bodies 17 are mounted at the radially outer sides of the clamping arms 14 in the region of the clamping zone 16 and these rolling elements 17 abut against a frustoconical guide face 18 tapering in a direction away from the conical end portion 2 of a clamping cone or tubular means 19. The clamping arms 14 are provided in the region of the rolling element 17 at their inner surfaces with clamping faces 20, which in the rear position of the clamping cone 19 as shown in FIG. 1, abut tightly against the lead 12 and hold the latter against axial movement. During movement of the clamping cone 19 toward the conical end portion 2, the clamping arms 14 open, due to their resilient construction, whereby the rolling element 17 remains in contact with the conical guide face 18, so that the clamping faces 20 are moved in radial direction away from the lead 12, but whereby the clamping arms 14 remain guided by means of the rolling elements 17 on the conical guide face 18 of the clamping cone or tubular means 19. Outside the region of the clamping faces 20, the inner radial distance between the clamping arms 14 is considerably greater than the diameter of the lead 12, so that the latter does not abut against the inner surfaces of the clamping arms outside the clamping faces 20. Due to the mentioned construction of the clamping zone 16, a symmetrical opening and closing of the clamping arms 14 is assured, so that no restraining transverse forces will act on the lead 12.

The clamping cone or tubular means 19 is in the region adjacent to the conical end portion 2 of the housing axially movably guided, substantially without radial play, in a bushing 21, which in turn is fixedly arranged within the housing 1. The centralizing bushing 15, and therewith the region of the clamping means 13 which faces away from the conical end portion 2 of the housing, is axially movably guided substantially without radial play, in a tubular portion 22 of the clamping cone or tubular means 19, whereby the already mentioned centralized guiding of the clamping means 13 over the whole length thereof in the closed and open position is assured. The bushing 21 is provided at its end thereof facing away from the conical end portion 2 of the housing with an inwardly projecting flange 23, the inner diameter of which is slightly greater than the outer diameter of the tubular portion 22, but smaller than the outer diameter of the actual clamping cone 19 so that a shoulder 24 forming at the junction between the actual clamping cone 19 and the tubular portion 22 abuts against the flange 23, in the end position of the clamping cone 19 illustrated in FIG. 1. A compression spring 27 is arranged between an outwardly projecting shoulder 25 of the centralizing bushing 15 and the facing end 26 of the tubular portion 22 of the clamping cone. This compression spring 27 will hold the clamping means 13 in the clamping position illustrated in FIG. 1, whereby the clamping arms 14 are stressed in longitudinal direction. This is obtained in that the clamping arms 14 engage by means of outwardly extending projections 28, at the ends thereof facing away from the conical portion 2 of the housing, in corresponding cutouts 29 in the centralizing bushing 15. The projections 28 are constructed in such a manner that they form a funnel 31 leading into the opening 30 between the clamping arms 14, so that leads 12 in the tubular lead magazine 32 may automatically slide into the opening 30. It is mentioned that the diameter of the opening 30 is evidently so small that two leads may not simultaneously move into the opening 30.

An inner end portion of the tubular lead magazine 32 is axially guided, substantially without radial play, on a corresponding portion of the tubular means 19. The tubular lead magazine 32 is further provided rearwardly of its inner end with an outwardly extending annular flange 33, adapted to engage a corresponding inwardly extending annular flange 34 provided at the inner surfaces of the housing 1, to prevent outward movement of the tubular lead magazine 32 beyond the position as shown in FIG. 1. A frustoconical compression spring 36 abuts with its small diameter end against the inner end face 36 of the tubular lead magazine 32, engaging at the same time with frictional contact the outer surface of the tubular means 19. The compression spring 36 engages with its other end against the flange 23 of the bushing 21. The compression spring 36 will assure that the tubular lead magazine 32 will abut in its extended position with its flange 33 against the flange 34 on the housing 1 and that the tubular means 19 with its shoulder 34 abuts against the flange 23 of the bushing 21.

The outer end of the tubular lead magazine 32 is closed by a cover 37, serving as actuating button, and held only by friction on the outer end of the tubular lead magazine 32, so as to be removable from the latter in order to fill replacement leads into the same. The actuating button 37 is guided along its cylindrical outer surface in axial direction and substantially without radial play in an inwardly extending flange 38 in the corresponding end of the housing 1. A plurality of nose-shaped abutments 39 project inwardly from the inner surface of the tubular lead magazine 32 directly adjacent to the corresponding end of the centralizing bushing 15, so that these abutments 39, during inward movement of the tubular lead magazine 32 upon pressure onto the actuating button 37, abut against the adjacent end face 40 of the centralizing bushing 15, to move the latter and the clamping means 13 in direction toward the conical end portion 2 of the housing.

FIGS. 5 and 6 illustrate in a transverse and longitudinal cross-section one embodiment of entrainment means connected to the inner end of the lead guide tube 4. The transverse cross-section of FIG. 5 is taken along the line 5—5 of FIG. 6. As shown in these two Figures the entrainment means comprises a carrier ring 51 fastened by means of a shrink fit onto the inner end of the lead guide tube 4 and carrying, on the side thereof directed toward the clamping means 13 shown in FIG. 1, a pot-shaped casing 52 connected to the carrier ring 51 with a pressfit and having an inner conical surface tapering toward the clamping means 13. The casing 52 is provided with three radially inwardly extending circumferentially displaced separating ribs 53 between which balls 52 are respectively arranged, which abut against the inner surface of the casing 52 as well as against a lead 12 passing therethrough. The distance between the inner ends of any two adjacent separating ribs 53 is smaller than the diameter of the balls 52 so that the latter, in the absence of a lead 12 may not move into contact with each other. The balls 54 are loaded by a coil compression spring 55 which abuts with opposite ends respectively against the bottom of an annular groove 56 formed in the carrier ring 51 and against the balls 54. In addition or alternative to the compression spring 55 an annular magnet 57 may be placed in the outer end of the casing 52 which attracts the balls 54, which in this case must consist of ferromagnetic material, so that the balls will abut without play against the inner surface of the casing 52 and the lead 12.

The embodiment shown in FIG. 7 differs from that illustrated in FIGS. 5 and 6 only, that instead of the separating ribs 53, the carrier ring 51 is provided with a tubular extension 58 formed with conical bores 59 in which the balls 54 are located.

Figure 9:
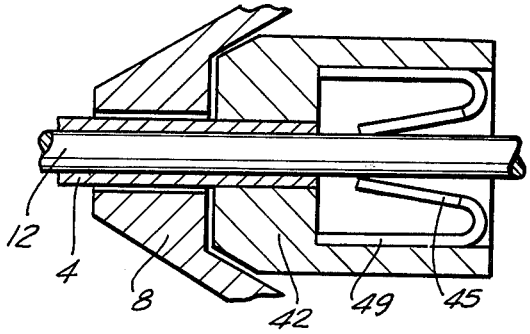
Figure 10:
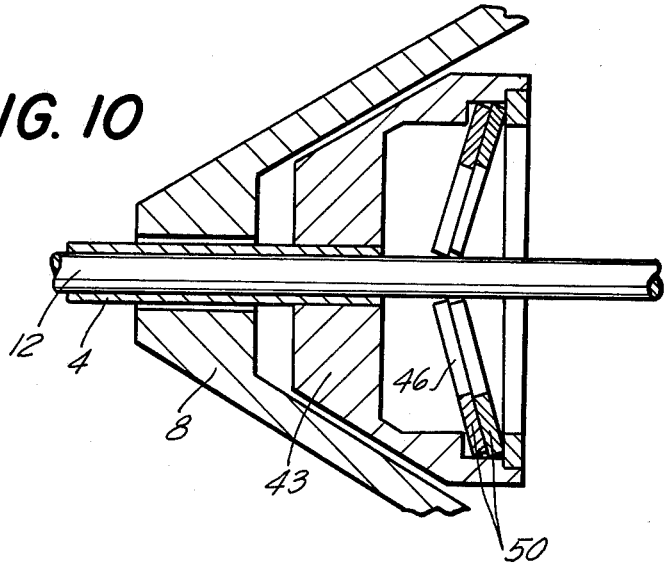

FIGS. 8–10 illustrate longitudinal cross-sections through further modifications of entrainment elements 11, which comprise respectively a carrier ring 41, 42 or 43 which is mounted with a pressfit axially immovably onto the inner end of the lead guide tube 4 and on which elastic, in the direction toward the conical end portion 2 of the housing extending, tongues 44, 45, 46 are respectively provided, which abut with the inner ends thereof elastically against the lead 12. In the embodiment shown in FIG. 8, a pot-shaped part 47 of soft elastic material, for instance rubber, is connected by means of a pressfit to the carrier ring 41 and forming with radial oblique inwardly extending portions the tongues 44. A housing 48 is placed over the pot-shaped part 47 to prevent that during inward movement of the lead 12 into the housing 1 the tongues 44 snap over in inward direction. To the contrary, during movement of the lead 12 into the housing 1, the tongues are compacted and abut thereby with a greater friction force against the lead 12.

In the embodiment according to FIG. 9, the tongues 45 form part of a spring basket 49, axially immovably connected to the carrier ring 42. In the embodiment shown in FIG. 10, the tongues 46 are formed between radial slots of spring washers 50.

Figure 11:
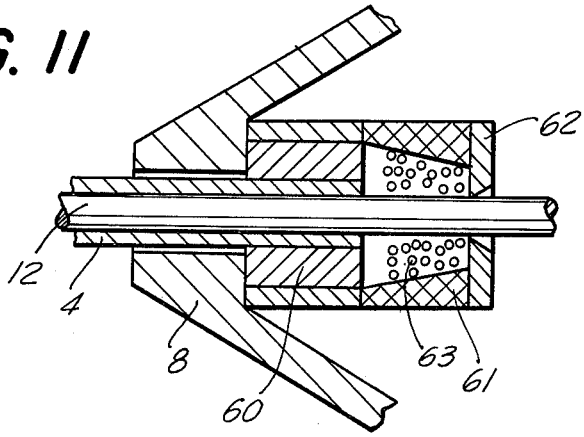

In the embodiment shown in FIG. 11 a carrier ring 60 is again by means of a pressfit axially immovably mounted on the corresponding inner end of the lead guide tube 4. A casing 61 is again by means of a pressfit axially immovably mounted on the carrier ring 60 and provided with an inner conical surface. An annular magnet 62 is fixedly mounted on the outer end of the casing 61 and the latter is filled with particulated ferromagnetic material, which abuts against the lead 12.

In all entrainment elements illustrated at FIGS. 5–11 the necessary force for moving the lead out of the lead guide tube 4 will be considerably smaller than the force necessary for moving the lead in the opposite direction.

FIGS. 12–27 illustrate various constructions of the clamping zone 16, all of which are made to prevent, during use of the mechanical pencil, a widening of the clamping faces 20 in a manner which would lead to a reduction of the forces holding the lead 12.

Figure 12:
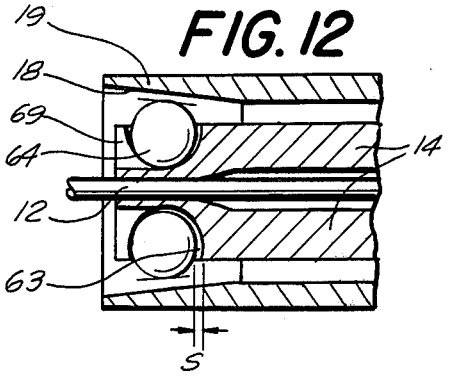
FIGS. 12–27 respectively illustrate in longitudinal and transverse cross-sections various constructions of the clamping arms in the region of the clamping zone of the pencil.
Figure 13:
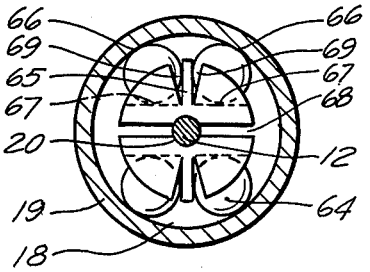

FIGS. 12 and 13 illustrate in axial and transverse cross-section a first modification of the elements forming the clamping zone. As shown in these two Figures each of the clamping arms 14 is provided at its free end and its outer side with a pair of V-shaped ball pockets 63 in which balls 64 are respectively located. Separating ribs 65 are repsectively provided between the two pockets 63 of each clamping arm 14, which will prevent that the balls 64 will influence each other and change their tangential position with respect to the respective clamping arm 14. The balls 64 respectively abut at points 66 against the conical guide face 18. In addition they abut also against the separating ribs 65 and at the points 67 on the clamping arms 14, which points are adjacent of a separating slot 68 between the two clamping arms 14. In this way pressure forces are imparted to the clamping arms 14 at opposite sides of the lead 12 which oppose widening of the clamping faces 20. In order to facilitate such a contracting deformation of the clamping arms 14, the latter are respectively formed with at least one expansion slot 69, by means of which the respective pocket 63 is cut at the free end face of the respective clamping arm 14.

Figure 14:
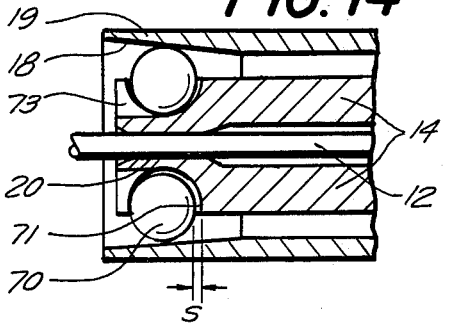
Figure 15:
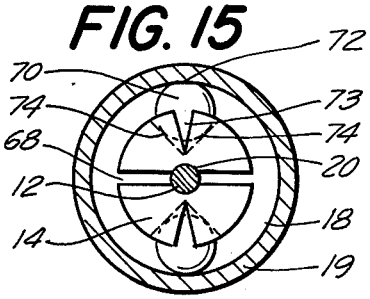

In the embodiment shown in FIGS. 14 and 15 each of the clamping arms 14 is provided only with one V-shaped pocket 71, which at the end face of the respective clamping arm is again provided with an expansion slot 73. A ball 70 is located in each pocket 71 and the contact points 72 of the balls with the conical guide face 18 are respectively located at a diameter of the balls which extend normal to the separating slot 68 between the clamping arms 14. Expansion slots 73 are again provided which are likewise substantially normal to the separating slot 68. Each ball 70 engages side faces of the pocket 71 at points 74, whereby again, by the pressure of the balls 70 rolling on the conical guide face 18, a deformation of the clampling arms 14 toward the separating slot 68 is accomplished. Even though only one ball 70 is coordinated with each of the clamping arms 14, a perfect tangential guiding of the latter is obtained.

Figure 16:
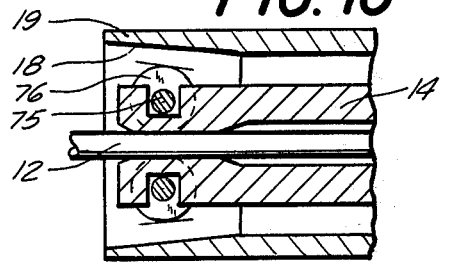
Figure 17:
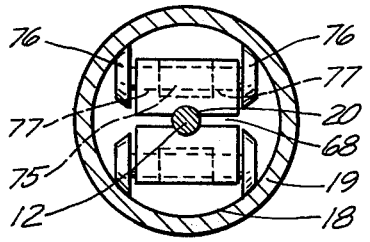

In the embodiment shown in FIGS. 16 and 17 the rolling elements are constituted respectively by two discs 76 connected to each other by a shaft 75 extending parallel to the separating slot 68, with the discs 76 abutting against the conical guide face 18. Each shaft 75 is mounted for rotation in bearings 77 laterally of the lead 12, whereby again the above-mentioned deforming forces are applied to the clamping arms 14.

Figure 18:
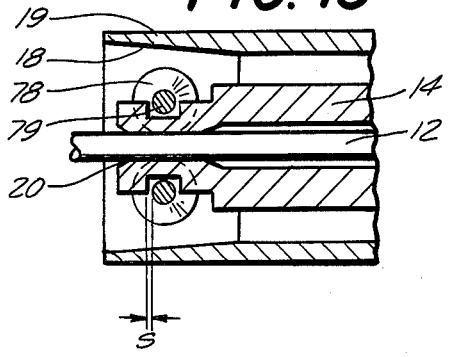
Figure 19:
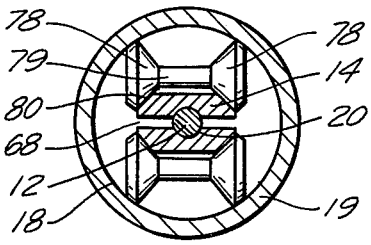

In the embodiment shown in FIGS. 18 and 19 the rolling elements are constituted by two conical discs 78 which are again connected to each other by a shaft 79. Each conical disc 78 abuts, on the one hand, against the conical guide face 18 and on the other hand, with its conical peripheral face against a corresponding inclined face 18 of the respective clamping arm 14.

Figure 20:
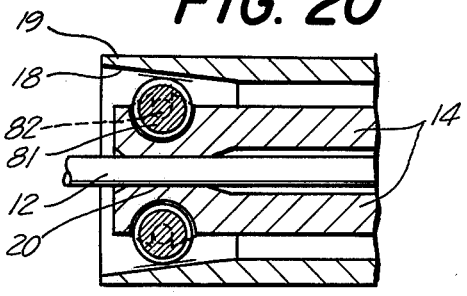
Figure 21:
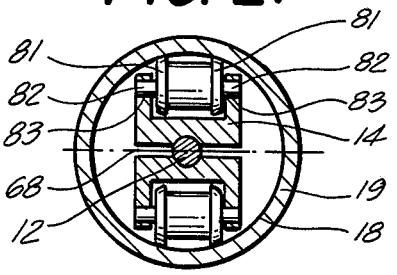

In the embodiment shown in FIGS. 20 and 21 the rolling element provided on each clamping arm 14 is constituted by two axially displaced and fixedly connected discs 81 which have outwardly projecting trunions 82, mounted in corresponding bearings 83 provided on the clamping arms. The discs 81 abut only against the conical guide face 18, whereas the deforming forces laterally of the lead 12 and normal to the separating slot 68 are transmitted over the bearings 83.

Figure 22:
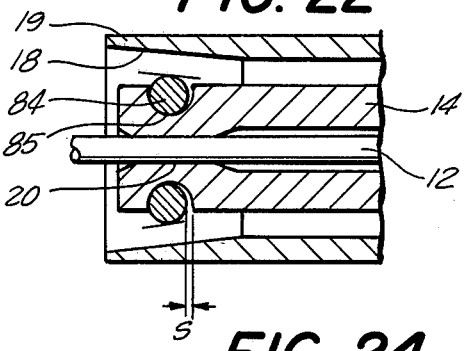
Figure 23:
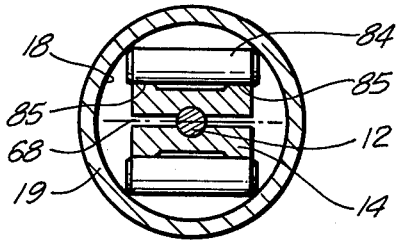

In the embodiment illustrated in FIGS. 22 and 23 each of the rolling elements is constituted by a cylindrical roll 84, which in the region of the outer ends thereof rolls on the guide face 18. Each roll 84 is supported only in the region of the outer ends thereof on bearing portions 85 of the respective clamping arm, whereby again the above-mentioned deforming forces will be enacted normal to the separating slot 68 and to opposite sides of the lead 12.

Figure 24:
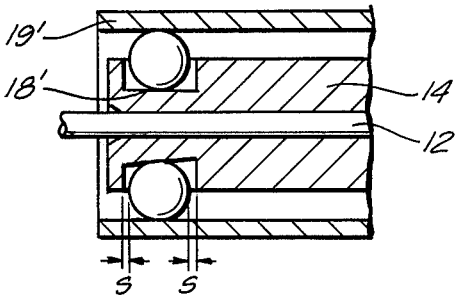
Figure 25:
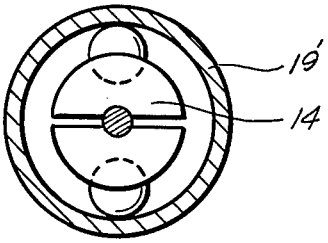

In the construction of the clamping zone 16 according to the FIGS. 12, 13; 14, 15; 18, 19 and 22, 23 it is also possible to use instead of the conical guide face 18 a cylindrical bushing 19' and to place the necessary inclined faces 18' for the clamping of the clamping arms into the clamping arms 14, as illustrated in FIGS. 24 and 25.

In the embodiment illustrated in FIGS. 12, 13; 14, 15; 18, 19; 22, 23 and 24, 25, in which the respective rolling element 64, 70, 78, 84 abut directly against the corresponding clamping arms 14, it is necessary that the coordinated pockets 63, 71, respectively the bearings 84, are provided with a small axial clearance s, in order to obtain a smooth roll off movement free of sliding friction in the moment of detachment of the clamping connection between the guide face 18 and the rolling elements. This clearance s can be held very small for instance only a few tenths of a millimeter.

Figure 26:
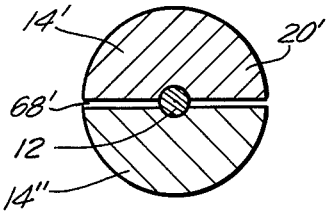
Figure 27:
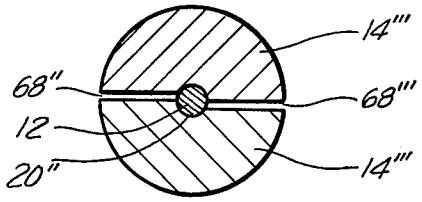

The holding force imparted by the clamping means 13 onto a lead 12 may also be influenced by the arrangement of the separating slot between the clamping arms 14 relative to the lead 12. FIG. 26 illustrates a construction in which the separating slot 68 between the two clamping arms 14' and 14'' is located outside the center line of the lead 12 to be clamped. Thereby a greater clamping action will be obtained by the clamping face 20' with the larger peripheral surface and especially when the diameter of the cylindrical clamping face 20' is slightly smaller than the diameter of the lead 12. FIG. 27 illustrates two clamping arms 14''' constructed in such a manner that the separating slots 68'' and 68''' to opposite sides of a lead 12 are offset with respect to each other. Due to the cooperation of the two clamping arms there will be obtained a clamping of the lead 12 substantially over the full peripheral surface of the coordinated clamping faces 20''.

Figure 3:
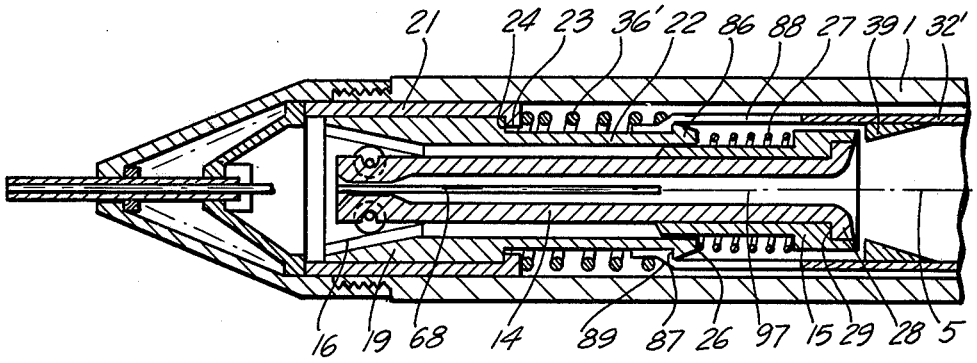
FIG. 3 is a partial longitudinal cross-section through a modification according to the present invention.

FIG. 3 illustrates a modification of the mechanical pencil shown in FIGS. 1 and 2 in which the cylindrical portion 22 of the clamping cone 19 is provided in the region of its inner end face 26 with barbed projections 86. The tubular lead magazine 32' is correspondingly formed at its inner end thereof with inwardly extending projections 87 and provided with longitudinally extending slots 88 so that the projections 87 may be moved over the projections 86, to thereby provide a tension-proof connection between the tubular lead magazine 32' and the clamping cone or tubular means 19. The tubular lead magazine 32' is provided in the region of the projections 87 at the outer surface thereof with faces 89 which in direction toward the clamping zone 16 are inclined toward the axis 5. A coil compression spring 36' abuts with one end against the inclined faces 89 and with its other end against the bushing 21. Due to the pressure of the compression spring 36' onto the inclined faces 89, the inner faces of the projections 87 are pressed against the outer surface of the cylindrical portion 22, providing thereby a light friction connection. Otherwise the construction shown in FIG. 3 is identical with the construction illustrated in FIGS. 1 and 2.

Figure 4:
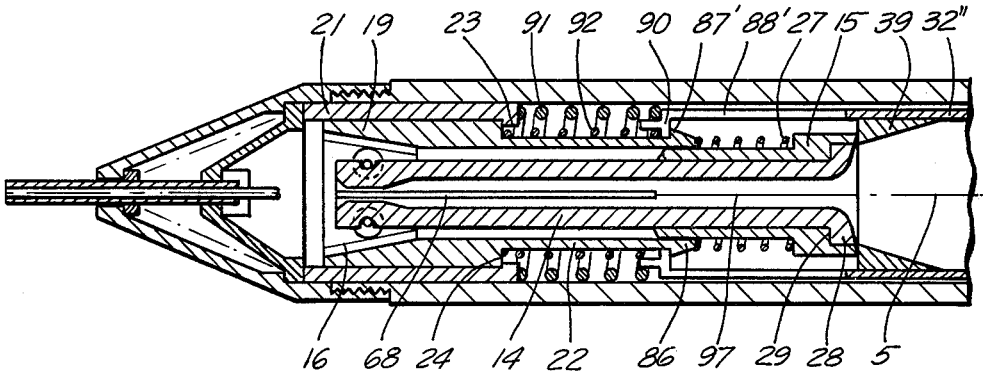
FIG. 4 is a partial longitudinal cross-section through a second modification of a mechanical pencil according to the present invention.

In the embodiment shown in FIG. 4, the clamping cone 19 with its cylindrical portion 22 is likewise provided with outwardly extending barb-shaped projections 86. The tubular lead magazine 32' is provided at its inner end with radially inwardly extending projections 87' and is likewise provided in the region of the inner end portion with longitudinally extending slots 88', in order to move the projections 87' over the projections 86. the projections 87' are provided on the side thereof facing the clamping zone 16 with radial abutment faces 90, against which one end of an outer coil compression spring 91 abuts, the other end of which abuts against the flange 23 of the bushing 21, to thus provide for a return movement of the tubular lead magazine 32' and of the clamping cone 19 by means of the projections 87'. An inner additional coil compression spring 92 abuts with one end against the shoulder 24 of the clamping cone 19 and with the other end against the face 90 of the tubular lead magazine 32'' to assure thereby that during movement of the tubular lead magazine 32' toward the conical end portion 2 of the housing the clamping cone 19 is taken along.

The above-described various modifications of the construction of the mechanical pencil according to the present invention will be operated as follows:

In order to render the pencil operative, a lead 12 must be moved from the storage compartment 94 of the tubular lead magazine 32 into the lead guide rube 4. For this purpose the pencil is held in substantially vertical position so that a lead 12 may drop into the opening 30 of the clamping means 13 up to the clamping faces 20. In the region of the clamping faces the clamping arms 14 abut nearly or completely against each other, that is, the separating slot 68 is smaller than illustrated in the various Figures of the drawing, since no lead is located between the clamping faces 20.

The tubular lead magazine 32 is now moved inwardly into the housing by pressure exerted onto the actuating button 37 so that the clamping means 13 are moved by means of the abutments 39 likewise in the same direction. Thereby the conically coiled compression spring 36, which abuts with one end against the end face 35 of the tubular lead magazine 32, is compressed and takes, due to the clamping friction connection with the tubular portion 22 of the clamping zone 19, the latter along until the clamping cone abuts with its front end against the stop 95 formed at the rear face of the bearing 8. During this movement up to the point of abutment there will be no relative movement between the clamping means 13 and the clamping cone 19, that is, the clamping means 13 remain in their closed position. Subsequently thereto, during further inward movement of the actuating button 37 and further compression of the compression springs 36 and 27 only the clamping means 13 is taken along, whereby the rolling elements roll on the conical guide face 18. Thereby the clamping means 13 are opened. This position is illustrated in FIG. 2. Now the lead 12 may drop downwardly up to the inner surface of the entrainment element 11.

Subsequently thereto the actuating button 37 is released so that the compression spring 36, due to its friction connection with the outer surface of the tubular portion 22 of the clamping cone, moves the latter backwardly until its shoulder 24 abuts against the flange 23 of the bushing 21. During this movement the clamping means 13 remains in open position. During further return movement of the tubular lead magazine 32 through the action of the compression spring 36, the abutment 39 will become disengaged from the end face 40 of the centralizing bushing 15, so that the latter and the clamping means 13 will be moved by the force of the compression spring 27 relative to the clamping cone 19 in the direction toward the actuating button 37 and thus brought into closing position. The lead 12 will thereby in the last moment of closing of the clamping means 13 be clamped between the clamping faces 20 thereof, that is, this clamping of the lead 12 in the clamping means 13 occurs without moving thereby the lead 12 again axially in the direction toward the actuating button 37.

During renewed actuating of the actuating button 37 the above-described procedure is repeated, whereby the lead clamped between the clamping arms 14 is taken along over the distance a between the end of the clamping cone 19 and the stop 95 (see FIG. 1). The lead 12 is thereby moved into the entrainment element 11. If now the actuating button 37 is further pressed inwardly then the clamping means opens in the above-described manner and closes again after release of the actuating button 37 in its rear position. If the actuating button 37 is not pressed inwardly up to the opening of the clamping means 13, but already released in the forward closing position of the clamping means 13, then the entrainment element 11 holds the lead 12 since, as described above it will exert different holding respectively firction forces onto the lead 12 in the two moving directions of the latter. In this case the clamping means will be slightly open since the compression spring 37 is dimensioned in such a manner that the holding force of the entrainment element 11 against an inward movement of the lead is slightly greater than the clamping force of the clamping means 13 at the clamping faces 20 thereof provided by the compression spring 27.

By repeated actuation of the actuating button 37 the lead 12 is moved forwardly up to the outlet end 96 of the lead tube 4. The mechanical penical according to the present invention is now ready for use and will operate automatically until the lead is substantially used up. The lead 12 needs thereby not visibly project beyond the outlet opening 96 of the lead tube 4, but the outer end of the lead may be substantially located at the outlet end 96 so that the lead 12 in the region of its outer end during writing is properly supported in the lead tube 4.

During the writing process, the lead tube 4 will be moved against the force of the spring 9 into the conical portion 2 of the housing, whereby the light friction force between the entrainment element 11 and the lead 12 is overcome since the lead 12 is fixedly clamped between the clamping faces 20.

During release of the lead tube 4, which continuously and instinctively occurs during lifting of the pencil from the writing surface, the lead tube 4 is, through the action of the compression spring 9, again moved into its forward end position, whereby the lead 12 due to the holding force of the entrainment element 11 is taken along. During this outward movement of the lead tube 4, the clamping means 13 will also slightly open since the compression spring 27 will yield slightly so that the lead 12 may be moved relative to the clamping faces 20.

It is also mentioned that the clamping arms 14 in the region encompassed by the centralizing bushing 15 abut with lateral faces 97 against each other and that the separating gap 68 will start only at the inner end of the centralizing bushing 15.

It will be understood that each of the elements described above, or two or more together, may also find a useful application in other types of mechanical pencils differing from the types described above.

While the invention has been illustrated and described as embodied in a mechanical pencil, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letter Patent is set forth in the appended claims.

1. In a mechanical pencil with automatic lead feed, a combination comprising tubular housing means having opposite ends; a tubular lead magazine coaxially guided in said housing means moveable between a retracted and an extended position in which one end of the tubular lead magazine projects further beyond one end of said housing means than in said retracted position; a lead guide tube coaxially guided in said housing means in the region of the other end of the latter movable between a first and a second position in which one end of said tubular guide projects through a smaller distance beyond said other end of said housing means than in said first position; first spring means cooperating with said lead guide tube for biasing the latter to said first position; means for feeding a lead from said lead magazine into said lead guide tube and comprising tubular means coaxially guided in said housing means between two end positions and having at one end adjacent said other end of said housing means an inner conical guide face having a large diameter at said one end of said tubular means and tapering from said large diameter toward the axis of said tubular means, clamping means extending longitudinally through said tubular means and comprising a pair of resilient clamping arms having front ends adjacent said conical guide face and biased to move toward the latter and rolling elements carried by said front ends and engaging said conical guide face, said clamping means being movable relative to said tubular means between a rear clamping position in which said rolling elements are spaced from said one end of said tubular means to clampingly engage with clamping faces thereof a lead located therebetween and a forward releasing position, and second spring means between said tubular means and said clamping means and biasing the latter to said clamping position; third spring means between said housing means and said tubular lead magazine for biasing the latter to said extended position and to yieldably couple said tubular lead magazine to said tubular means, whereby during movement of said tubular lead magazine from said extended toward said retracted position, said tubular means is moved from one to its other end position; cooperating means on said tubular magazine and said clamping means for moving the latter together with said tubular means during movement of said tubular means to said other end position while said clamping means remain in said clamping position so as to feed a lead clamped therebetween toward said lead guide tube until said tubular means reaches its other end position, whereby during further movement of said tubular lead magazine to said retracted position said clamping means is moved relative to said tubular means so that said rolling elements move toward said large diameter of said conical guide face causing thereby disengagement of said clamping faces from a lead therebetween; and entrainment means on said lead guide tube constructed to exert on a lead extending through said lead guide tube during movement relative to the tube into said housing means a greater friction force than during movement of the lead relative to the tube in the opposite direction.

2. A combination as defined in claim 1, and including a removable cover for closing said tubular lead magazine at the end thereof projecting beyond said housing means.

3. A combination as defined in claim 1, wherein said clamping means comprises a centralizing bushing axially guided in said tubular means and said tubular lead magazine and engaging said resilient clamping arms opposite said front ends thereof.

4. A combination as defined in claim 3, wherein said clamping arms have throughout the length of said centralizing bushing abutment faces abutting against each other and are separated from each other outside said centralizing bushing by a gap.

5. A combination as defined in claim 4, wherein said separating gap is assymetrically arranged with respect to a center line of a lead arranged between said clamping arms.

6. A combination as defined in claim 4, wherein said separating gap at one side of a lead between said clamping arms is offset with respect to said gap at the other side of the lead.

7. A combination as defined in claim 1, wherein said entrainment means is mounted on the other end of said lead guide tube.

8. A combination as defined in claim 7, wherein said entrainment means comprises a casing connected to said lead guide tube and having an inner conical surface tapering in a direction away from said one end of said lead guide tube, a plurality of balls in said casing engaging said conical surface, and means biasing said balls in a direction toward said clamping means.

9. A combination as defined in claim 8, wherein said casing comprises a plurality of ribs separating said balls from each other.

10. A combination as defined in claim 8, and including a carrier ring connecting said casing to said lead guide tube, said carrier ring having an extension projecting coaxially through said casing and being provided with a plurality of openings in which said balls are respectively lodged.

11. A combination as defined in claim 8, wherein said means biasing the balls in said direction comprise a compression spring.

12. A combination as defined in claim 8, wherein said means biasing the balls in said direction comprise a magnet.

13. A combination as defined in claim 7, wherein said entrainment means comprise a plurality of elastic tongues inclined towards said lead guide tube and having free ends engaging a lead extending through said lead guide tube.

14. A combination as defined in claim 13, wherein said tongues form part of a pot-shaped member from soft resilient material, and including an outer housing surrounding said pot-shaped member.

15. A combination as defined in claim 13, wherein said tongues form part of a metallic basket-shaped spring element.

16. A combination as defined in claim 13, wherein said tongues form part of slotted spring washers.

17. A combination as defined in claim 7, wherein said entrainment means comprises a casing connected to said lead guide tube and having an inner conical surface tapering in a direction away from said one end of said lead guide tube and including ferromagnetic particles substantially filling said casing and a magnet on that end of the casing which faces said clamping means.

18. A combination as defined in claim 1, wherein said third spring means is a conical compression spring frictionally and clampingly engaging with its small diameter end the outer surface of said tubular means.

19. A combination as defined in claim 1, wherein said tubular lead magazine has at an end portion opposite said one end thereof an outer inclined surface, said third spring means abutting with one end thereof against said inclined surface.

20. A combination as defined in claim 19, wherein said end portion of said tubular lead magazine is provided with axially extending slots and with radially inwardly extending projections which overlap corresponding projections provided on said tubular means, said inclined surface being provided in the region of said projections.

21. A combination as defined in claim 1, wherein said third spring means comprises two coaxial compression springs, one abutting with opposite ends against said tubular means and said tubular lead magazine, and the other abutting with opposite ends against said housing means and said tubular lead magazine.

22. A combination as defined in claim 1, wherein each of said clamping arms is provided in the region of said rolling elements with a radially extending expansion slot.

23. A combination as defined in claim 1, wherein each of said clamping arms is provided in the region of said front end thereof with two pockets separated by a rib, said rolling elements are constituted by balls respectively located in said pocket.

24. A combination as defined in claim 1, wherein each of said rolling elements is an integral element constructed to abut with two points thereof against said conical guide surface and with two other points thereof against the respective clamping arm.

* * * * *